US011752790B2

(12) United States Patent
Lo et al.

(10) Patent No.: US 11,752,790 B2
(45) Date of Patent: Sep. 12, 2023

(54) BASE DEVICE TO PREVENT TIP AND TILT OF FINISHER

(71) Applicant: HEWLETT-PACKARD DEVELOPMENT COMPANY, L.P., Spring, TX (US)

(72) Inventors: Kevin Lo, Vancouver, WA (US); Alexander M. Nameroff, Vancouver, WA (US); Taehong Kim, Pangyo (KR); Taejin Baek, Pangyo (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 56 days.

(21) Appl. No.: 17/041,310

(22) PCT Filed: May 10, 2018

(86) PCT No.: PCT/US2018/032100

§ 371 (c)(1),
(2) Date: Sep. 24, 2020

(87) PCT Pub. No.: WO2019/216899

PCT Pub. Date: Nov. 14, 2019

(65) Prior Publication Data

US 2021/0016582 A1 Jan. 21, 2021

(51) Int. Cl.

| | |
|---|---|
| ***B41J 29/02*** | (2006.01) |
| ***G03G 21/16*** | (2006.01) |
| ***B41J 13/10*** | (2006.01) |

(52) U.S. Cl.

CPC ..... *B41J 29/02* (2013.01); *B41J 13/106* (2013.01); *G03G 21/1619* (2013.01)

(58) Field of Classification Search

CPC ..... B41J 29/02; G03G 21/1619

See application file for complete search history.

(56) References Cited

U.S. PATENT DOCUMENTS

| | | | |
|---|---|---|---|
| 7,404,551 | B2 | 7/2008 | Brown et al. |
| 8,215,765 | B2 | 7/2012 | Murase |

(Continued)

FOREIGN PATENT DOCUMENTS

| | | | |
|---|---|---|---|
| EP | 2033872 | B1 | 3/2009 |
| JP | H0844130 | A * | 2/1996 |

(Continued)

*Primary Examiner* — Justin Seo
*Assistant Examiner* — Kendrick X Liu
(74) *Attorney, Agent, or Firm* — Brooks, Cameron & Huebsch, PLLC

(57) ABSTRACT

A base device to support a finisher includes a base pan, a first plurality of casters coupled to the base pan, a second plurality of casters coupled to the base pan, and a recess to receive a tip foot. The base pan includes a section which protrudes outward from a first side of the base pan. The first plurality of casters are coupled to the base pan to contact a surface when the base pan is level with respect to the surface, each of the first plurality of casters being beside a respective separate corner of the base pan and at least two of the first plurality of casters being beside the section. The second plurality of casters are to be positioned above the surface when the base pan is level with respect to the surface and to contact the surface when the base pan is inclined to a threshold.

18 Claims, 6 Drawing Sheets

(56) References Cited

U.S. PATENT DOCUMENTS

| | | | | |
|---|---|---|---|---|
| 9,743,543 | B2 | 8/2017 | Anderson et al. | |
| 2012/0098395 | A1 | 4/2012 | Sato | |
| 2013/0114985 | A1 | 5/2013 | Warner et al. | |
| 2017/0034935 | A1 * | 2/2017 | Anderson | F16C 11/04 |
| 2017/0038726 | A1 | 2/2017 | Agata | |

FOREIGN PATENT DOCUMENTS

| | | | |
|---|---|---|---|
| JP | 9236960 | | 9/1997 |
| JP | 4097046 | B2 * | 6/2008 |
| JP | 2009157152 | | 7/2009 |
| JP | 201534863 | | 2/2015 |

* cited by examiner

BASE DEVICE TO PREVENT TIP AND TILT OF FINISHER

CROSS REFERENCE TO RELATED APPLICATIONS

This application is a U.S. National Stage Application which claims the benefit under 35 U.S.C. § 371 of International Patent Application No. PCT/US2018/032100 filed on May 10, 2018, the contents of which are incorporated herein by reference.

BACKGROUND

A finisher refers to an apparatus for processing a recording medium supplied from an image forming apparatus. The finisher can be connected to the image forming apparatus to receive the recording medium during a job, and is in communication with the image forming apparatus. For example, the finisher may perform a stapling operation, an alignment operation, and/or a folding operation with respect to the recording medium supplied from the image forming apparatus.

An image forming apparatus refers to an apparatus that forms images on a recording medium according to inputted signals. Examples of an image forming apparatus include a printer, a copy machine, a scanner, a facsimile, and a multi-function peripheral device that combines and implements various functions of the printer, copy machine, scanner, and/or facsimile. Examples of a printer include an inkjet printer or a laser printer.

DETAILED DESCRIPTION

Figure 1:
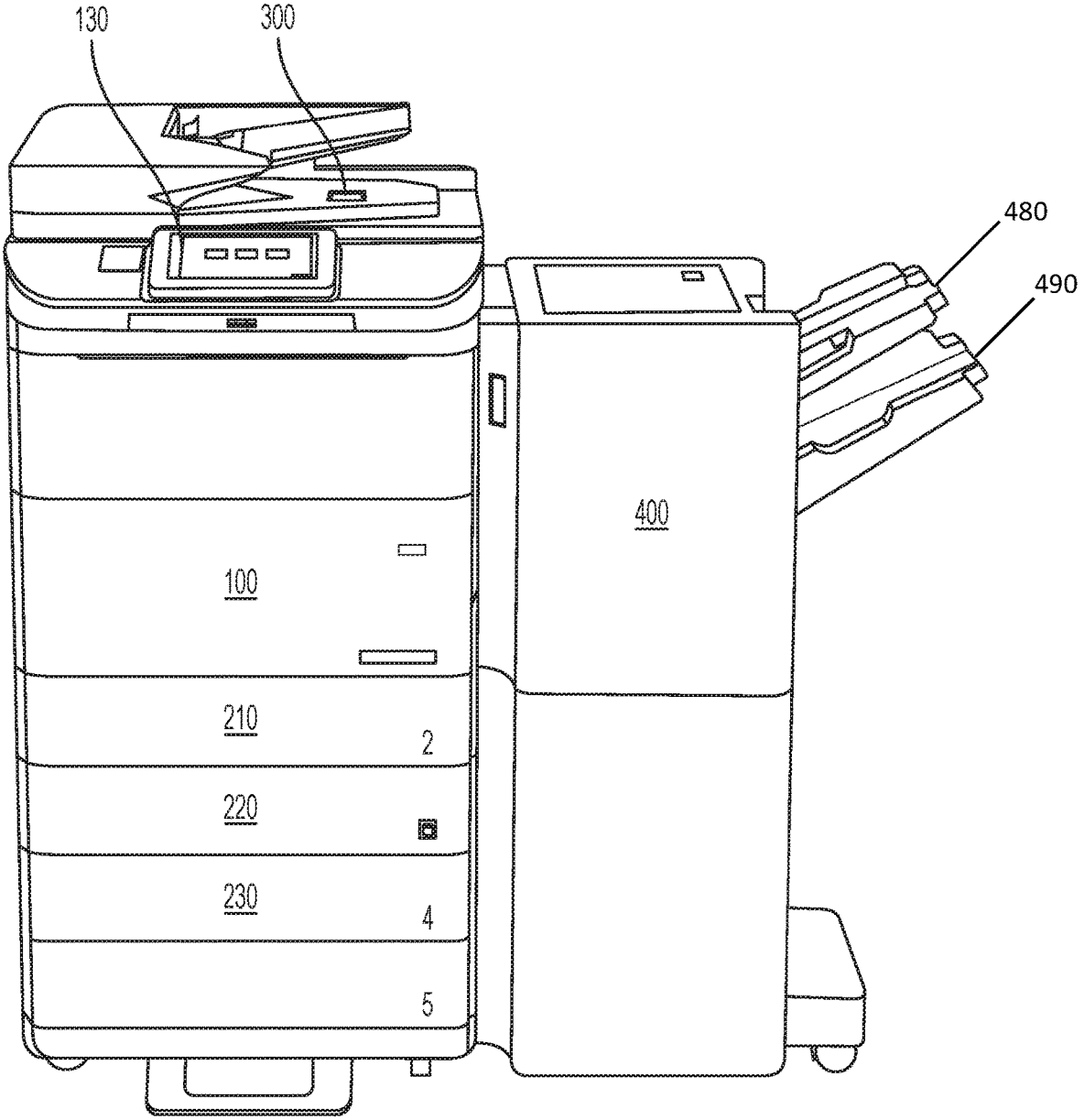
FIG. 1 is a schematic structural diagram of an image forming apparatus and finisher according to an example.

Previously, finishers were often sold contractually and therefore a purchaser did not need to setup the finisher as setting up the finisher was contracted out to a qualified third party. However, when a finisher is sold to a client that requires the client to setup and/or move the finisher, the finisher needs to meet more stringent safety requirements than if the finisher was sold contractually. The finisher sold to a client that requires the client to setup and/or move the finisher may need to meet safety specification IEC 60950-1. For example, these requirements may be that a finisher remains stable when subject to an angle of up to 10 degrees. In addition, the requirements may include a finisher needing to remain stable when subject to a force equaling up to 20% of the finisher mass is applied to the highest vertical surface from the ground. These requirements may also include a finisher needing to remain stable when this force is applied to each of the sides of the finisher. Previous finishers have had difficulty meeting these more stringent safety requirements as pervious finishers may have had difficulty being stable at an angle of 10 degrees and being stable when a force of 20% of the finisher mass is applied to a finisher at the highest vertical surface from the ground on each side of the finisher.

A base device for a finisher includes a base pan that includes a section which protrudes outward from a first side of the base pan. The base device further includes a first plurality of casters coupled to the base pan to contact a surface when the base pan is level with respect to the surface, each of the first plurality of casters being beside a respective separate corner of the base pan and at least two of the first plurality of casters being beside the section. The base device further includes a second plurality of casters coupled to the section of the base pan, to be positioned above the surface when the base pan is level with respect to the surface and to contact the surface when the base pan is inclined to a threshold to help prevent the finisher from falling over when the base pan is inclined. Each of the second plurality of casters have a diameter smaller than a diameter of each of the first plurality of casters. The base pan further includes a recess, included in the section of the base pan between at least two of the second plurality of casters, to receive a tip foot to help prevent the finisher from falling over when the base pan is inclined. Therefore, the base device prevents the finisher from tipping over when the finisher is inclined at an angle of 10 degrees. The base device also prevents the finisher may be prevented from tipping over when a force of 20% of the finisher mass is applied to the finisher at the highest vertical surface from the ground on each side of the finisher.

The finisher may also include a sensor to detect an amount of recording media in an output bin, and when the detected amount of recording media is above a predetermined threshold, the finisher will inform a control panel the amount of recording media in the output bin is greater than the predetermined threshold so the control panel can then inform a user to remove recording medium from the output tray to remove excess recording medium from the output bin to reduce the chances of the finisher falling over when the finisher is being moved.

Various examples of the disclosure will now be described in greater detail with reference to the accompanying drawings, wherein like reference characters denote like elements. Examples to be explained in the following may be modified and implemented in various different forms.

When it is stated in the disclosure that one element is "connected to" or "coupled to" another element, the expression encompasses not only an example of a direct connection or direct coupling, but also a connection with another element interposed therebetween. Further, when it is stated herein that one element "includes" another element, unless otherwise stated explicitly, it means that yet another element may be further included rather than being excluded.

FIG. 1 is a schematic structural diagram of an image forming apparatus and finisher 400 according to an example. Referring to FIG. 1, the image forming apparatus includes a printer 100 and a scanner 300 coupled to a finisher 400.

The printer 100 prints an image on a sheet-type medium, which may also be referred to as a recording medium, provided from a paper feeder. The recording medium may include, for example, paper such as glossy paper, plain paper, art paper, overhead projector film, cardstock, and the like. The paper feeder may be, for example, a main cassette feeder 210 installed under the printer 100, or secondary cassette feeders 220 and 230 installed under the main cassette feeder 210. Although not illustrated, the paper feeder may further include a multi-purpose tray (MPT), a high capacity feeder installed at a side of the printer 100, or a combination thereof.

The printer 100 may also include a control panel 130 to receive an input from a user to control the image forming apparatus, for example to perform a function of the image forming apparatus. The control panel 130 may include a keyboard, a button, a display, or combinations thereof for the user to operate the image forming apparatus. The display may be a touchscreen to receive the input from the user.

The printer 100 may print an image on a recording medium by using various printing methods such as an electrophotography method, an inkjet method, a thermal transfer method, and a thermal sublimation method. For example, the image forming apparatus may print a color image on the recording medium by using an inkjet method. The printer 100 may be a S path-type of printer or a C path-type of printer, for example.

The scanner 300 reads an image recorded on a document. The scanner 300 may have any of various structures such as a flatbed mechanism where a document is at a fixed position and an image is read while a reading member is moved, a document feeding mechanism where a reading member is at a fixed position and a document is fed, and a combination structure thereof.

The finisher 400 may include a sheet folding device (not illustrated) for folding, one or more times, the recording medium discharged from the printer 100. The finisher 400 may further include an alignment device (not illustrated) for aligning the recording medium discharged from the printer 100. The alignment device may have a structure for stapling the recording medium at an end portion thereof or punching a hole in an end portion of the recording medium. The finisher 400 may further include a stapler for stapling the paper at a center portion thereof. Other example processes or functions the finisher 400 may perform include hole punching, binding, embossing, gluing, coating, varnishing, foil stamping, texturing, lamination, cutting, creasing, stacking, binding, splicing, rewinding, or combinations thereof.

The finisher 400 in FIG. 1 includes an upper output bin 480 and a lower output bin 490. The upper output bin 480 may be utilized for simple jobs in which a finishing process or collated stacking is not performed. For example, a recording medium may be transported along an upper path to be output to the upper output bin 480 when a stapling operation is not performed on the recording medium. The lower output bin 490 may be utilized for jobs for which a stacking or stapling operation is performed. For example, a recording medium may be transported along a lower path to be output to the lower output bin 490 when a stapling operation is performed on the recording medium. The lower output bin 490 may be movable. For example, the lower output bin 490 may be lowered or raised. The lower output bin may 490 be lowered or raised depending on a number of recording media that are held by the lower output bin 490.

Figure 2:
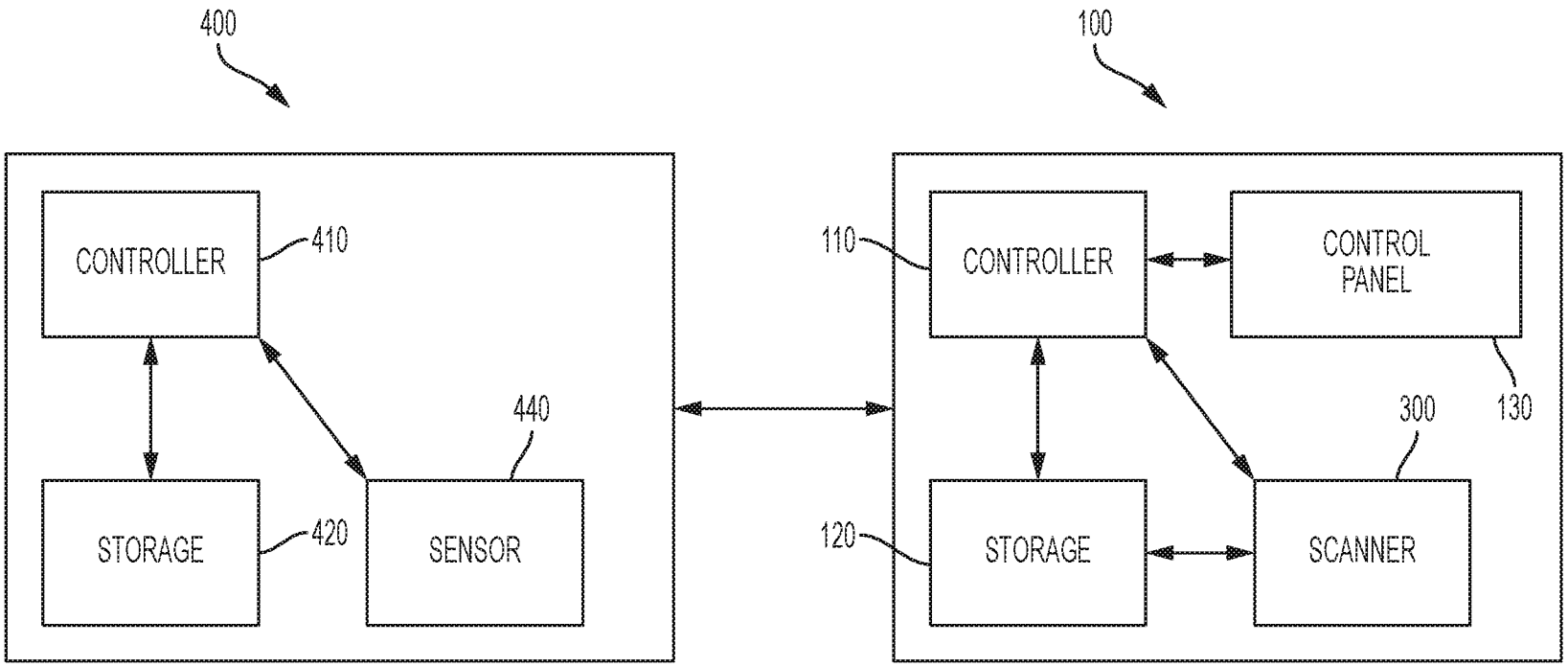
FIG. 2 is a block diagram of the printer and the finisher according to an example.

FIG. 2 is a block diagram of the printer 100 and the finisher 400, according to an example. In FIG. 2, the printer 100 includes controller 110 and machine readable storage 120, the finisher 400 includes controller 410 and machine readable storage 420. The finisher 400 also includes a sensor 440 which will be discussed in more detail below. The sensor 440 may include a position sensor that senses a position of a recording medium on a path in the finisher, a weight sensor, a proximity sensor, a light sensor, or combinations thereof.

The finisher 400 may include a controller 410 and machine readable storage 420. The controller 410 may execute instructions stored in the machine readable storage 420. The printer 100 may also include a control panel 130 and a scanner 300. The finisher 400 and printer 100 may be connected with one another in a wired and/or wireless manner such that the finisher 400 and printer 100 can communicate with one another to exchange information, including job information regarding an image forming job performed or to be performed by the image forming apparatus including the printer 100 and scanner 300, a finishing job performed or to be performed by the finisher 400, or combinations thereof.

The controllers 110, 410, may include, for example, a processor, an arithmetic logic unit, a central processing unit (CPU), a graphics processing unit (GPU), a digital signal processor (DSP), an image processor, a microcomputer, a field programmable array, a programmable logic unit, an application-specific integrated circuit (ASIC), a microprocessor, or combinations thereof.

The machine readable storages 120, 420, may be any electronic, magnetic, optical, or other physical storage device that stores executable instructions. For example, the machine readable storages 120, 420, may include a non-volatile memory device, such as a Read Only Memory (ROM), Programmable Read Only Memory (PROM), Erasable Programmable Read Only Memory (EPROM), and flash memory, a USB drive, a volatile memory device such as a Random Access Memory (RAM), a hard disk, floppy disks, a blue-ray disk, or optical media such as CD ROM discs and DVDs, or combinations thereof.

Figure 3:
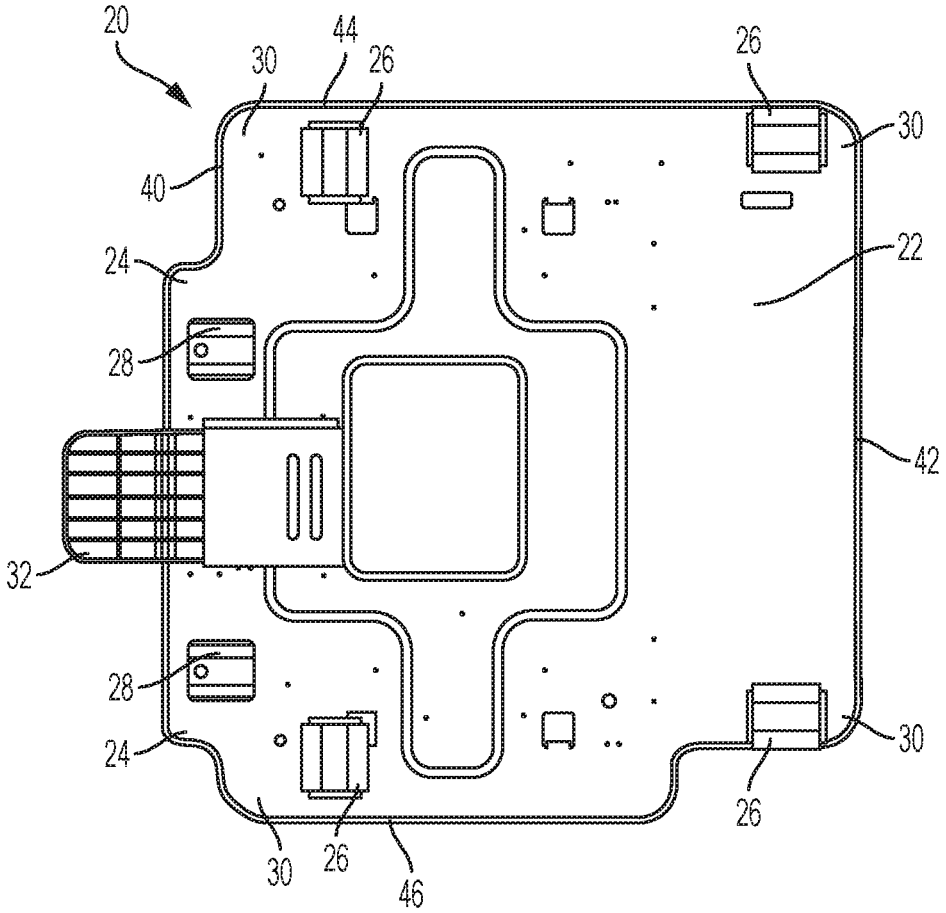
FIG. 3 is an underneath view of a supporting base device for a finisher according to an example.

FIG. 3 is a view of underneath a supporting base device 20 for a finisher. In an example, the base device 20 may be a separate device that is coupled to the finisher. In another example, the base device 20 may be a lower section of the finisher 400 itself and not be separate from the finisher 400.

The base device 20 includes a base pan 22. The base pan 22 may be a variety of polygon shapes. The base pan 22 may also be substantially square with a few sections extending outward to create a multi-sided polygon. The base pan 22 may be a variety of thicknesses. In an example, the thickness of the base pan 22 is between 0.6 mm and 2.0 mm. In another example, the thickness of the base pan 22 is 1.0 mm. However, the thickness of the base pan 22 is not limited to the thicknesses listed above.

For example, in FIG. 3, the base pan 22 includes a section 24 that protrudes outwards from the base pan. The section 24 protrudes from the first side 40 of the base pan 22. For example, the first casters 26 may be coupled to the base pan 22 and may be placed outwards towards the corners 30 of the base pan 22. For example, two of the first casters 26 coupled to the base pan 22 are located beside the protruding section 24 of the base pan 22, but are not coupled to the protruding section 24. While FIG. 2 shows four first casters, the first casters are not limited to four and may include any number of casters. For example, the corners 30 of the base pan 22 may be rounded or pointed.

For example, the second casters 28 are coupled to the protruding section 24 of the base pan 22. The base pan 22 may also include a recess 34 to receive a tip foot 32. For example, the recess 34 to receive the tip foot 32 is located between the second casters 28. While FIG. 3 shows two second casters 28, the second casters are not limited to two and may include any number of casters. For example, if the number of second casters is greater than two than the recess 34 to receive the tip foot 32 may be between any two of the plurality of second casters.

The recess 34 to receive the tip foot 32 may be located on the bottom side of the base pan 22 and/or on the bottom side of the section 24. In another example, the recess 34 may be located on first side 40 of the base pan 22. As an example, the recess may be comprised of sheet metal, but may be made of other substance as well.

Figure 4:
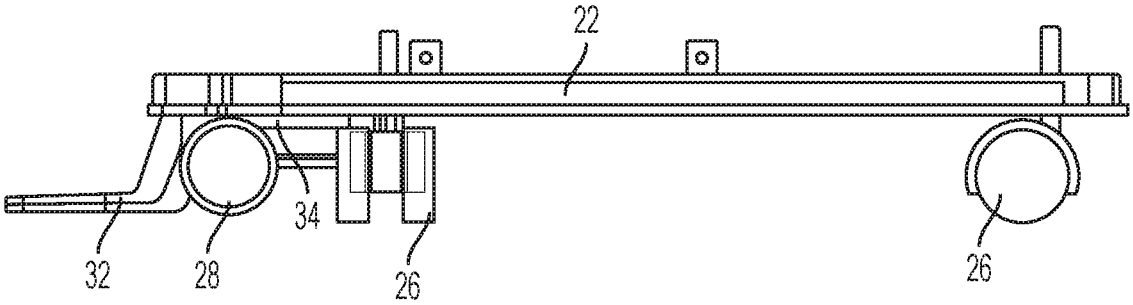
FIG. 4 is a side view of a supporting base device for a finisher according to an example.

For example, FIG. 4 shows a side view of the base supporting device 20 to support a finisher. In this illustration, the base pan 22 is level to the surface. For example, in FIG. 4, the second casters 28 have a smaller diameter than the first casters 26 and are thus raised above the surface when the base pan 22 is level to the surface. Thus, when the base pan 22 is level to the surface, the first casters 26 contact the surface while the second casters 28 do not come into contact with the surface. However, when the finisher is tilted which results in the base pan 22 being inclined to a threshold, the second casters 28 will come into contact with the surface. As an example, the inclination threshold may be based on the diameter of the second casters 28. The presence of the second casters 28 coming into contact with the surface when the base pan is tilted helps provide stability to the base pan 22 and helps prevent the finisher from tipping over.

FIG. 4 shows the tip foot 32 inserted into the recess 34. For example, in FIG. 4, when the base pan 22 is level to the surface and the tip foot 32 is inserted into the recess 34 of the base pan 22, the tip foot 32 does not come into contact with the surface. However, when the base pan 22 is inclined to a second threshold, the tip foot 32 will come into contact with the surface. As an example, the second threshold may depend on the distance the tip foot 32 is above the surface and the distance the tip foot 32 extends outward. The presence of the tip foot 32 coming into contact with the surface when the base pan 22 is inclined helps provide stability to the base pan 22 and helps prevent the finisher 400 from tipping over.

For example, the first casters 26 may be a variety of diameters. For example, the second casters 28 may also be a variety of diameters, such as, but not limited to, 5 mm or 10 mm. For example, in FIG. 4, the diameter of the second casters 28 is smaller than the diameter of the first casters 26. For example, the second casters 28 are non-adjustable while the first casters 26 are adjustable. However, the second casters 28 may be either adjustable or non-adjustable and the first casters 26 may be adjustable or non-adjustable.

As an example, due to the location of the first casters 26 and the second casters 28, the finisher 400 may rotatable when it is moved. In addition, the finisher may also be rotatable and movable while it is inclined or pushed while it is inclined.

For example, the tip foot 32 is removable with respect to the recess 34. The tip foot 32 may be inserted into the recess 34 and coupled to the base pan 22 by a variety of ways. The tip foot 32 extends outward from the perimeter of the base pan 22 and is located slightly above the surface when the tip foot 32 is inserted into the recess 34 and the base pan 22 is level to the surface. For example, the tip foot 32 may be "S"-shaped, but with straight lines. The tip foot 32 may also be other similar shapes or any other shape that will enable the tip foot 32 to have one end be inserted into the recess while the other end of the tip foot extends outward from the perimeter of the base pan 22 and resides slightly above the surface when the base pan is level. For example, the tip foot 32 may be 1-3 mm above the surface when the base pan 22 is level. However, the amount the tip foot 32 is above the surface when the base pan is level is not limited to this amount. For example, the tip foot 32 may extend outward from the perimeter of the base pan 22 by 10-40 mm. However, the amount the tip foot 32 is extend outward from the perimeter of the base pan 22 is not limited to this amount.

As an example, the tip foot 32 may made of dense plastic. However, the tip foot 32 may also be made of other substances as well.

For example, the first side 40 of the base pan 22 is located below a side of a finisher 400 that will receive media output from the printer 100. For example, the second side 42 of the base pan 22 is located below a side of the finisher 400 that outputs media to the first output bin 480 and the second output bin 490. For example, the third side 44 of the base pan 22 is located below a side of the finisher 400 that is on the same side of the control panel 110 of the printer 100 when the printer 100 is connected with the finisher 400. For example, the fourth side 46 of the base pan 22 is located opposite the third side 44 of the base pan.

Figure 5:
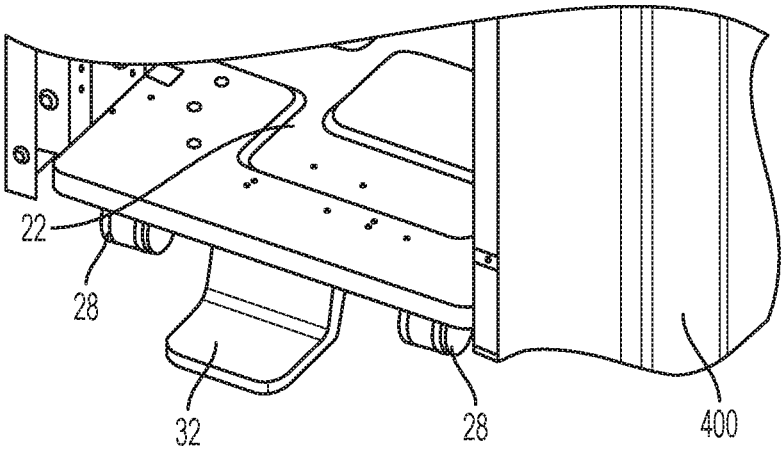
FIG. 5 is a perspective view of a supporting base device for a finisher with an inserted tip foot according to an example.

FIG. 5 shows the tip foot 32 inserted into the recess (not shown). For example, in FIG. 5, when the tip foot 32 is inserted into the base pan 22 it is located between two second casters 28. When the base pan 22 is inclined to a threshold, the inserted tip foot 32 will come into contact with the surface. The presence of the tip foot 32 coming into contact with the surface when the base pan 22 is inclined helps provide stability to the base pan 22 and helps prevent the finisher 400 from tipping over when the finisher 400 is subject to a force.

Figure 6:
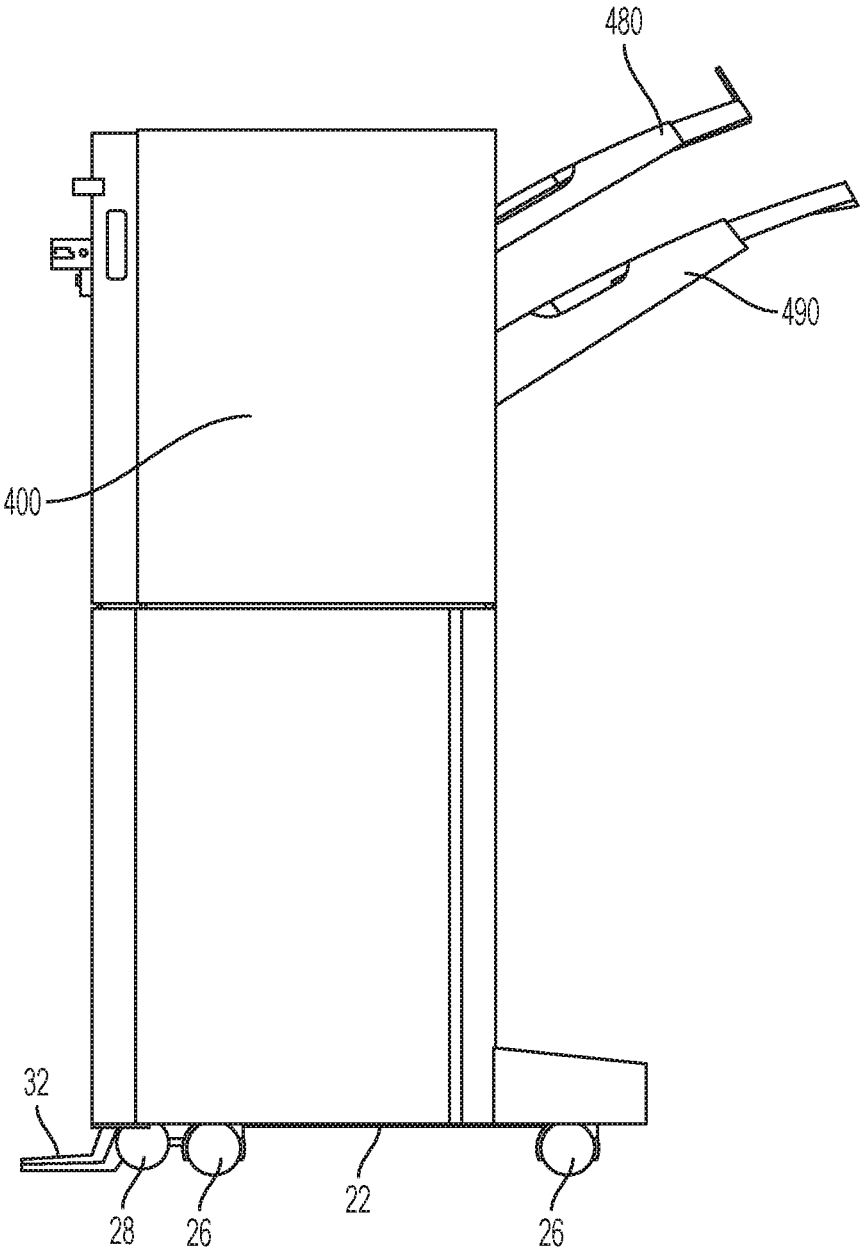
FIG. 6 is side view of a finisher with a supporting base device according to an example.

For example, FIG. 6 shows a side view of finisher 400 with the first casters 26 and the second casters 28 coupled to the base device 22 at the bottom of the finisher 400. For example, FIG. 6 also shows the tip foot 32 already inserted into a recess coupled to the base pan 22. For example, FIG. 6 shows the second casters 28 and the tip 32 being on a first side of the finisher 400. For example, FIG. 6 also shows the finisher 400 having a first output bin 480 and a second output bin 490 on a second side of the finisher 400 that is opposite the first side of the finisher 400.

In an example, if the amount of recording medium in either the first output bin 480 or second output bin 490 is greater than a threshold, the finisher 400 will be at a greater risk of falling over when the finisher 400 is put on an incline of 10 degrees or has a force applied to its highest point. For example, the threshold could be 400 pages of recording medium.

For example, the finisher 400 or printer 100 could determine a height of recording medium output in either the first output bin 480 or the second output bin 490. In the following example, we will discuss the sensor 440 locating a height of recording medium in the second output bin 490. However, a sensor 440 may also be used to locate a height of recording medium in the first output bin 480 as well. The finisher 400 could determine a height of recording medium in the second output bin 490 based on a proximity sensor or light sensor that measures a distance to an object. The sensor 440 can include the proximity sensor and/or the light sensor. The measured distance can be used to calculate or infer a height of the stack of media. The proximity sensor or light sensor could be located inside the finisher 400 at a location capable of measuring the height of the media in the output bin 490 and the height information could be transmitted to the controller 410. The height information could also be transmitted to the controller 110. The proximity sensor or light sensor can calculate the height of the stack media using time-of-flight principles, for example.

In another example, the sensor 440 may be located a position in the finisher 400 that detects the presence of the second output bin 490 or recording medium in the second output bin 490. The second output bin 490 is movable and moves downward when more recording medium is output into the output bin 490. When the second output bin 490 is moved downward enough due to the presence of a certain amount of recording medium, the sensor 440 will sense the presence of the second output bin 490. If even more recording medium is output to the output bin 490 where the second output bin 490 moves past the area where it can be sensed by the sensor 440, the sensor will locate the presence of the recording medium in the second output bin 490.

Figure 7:
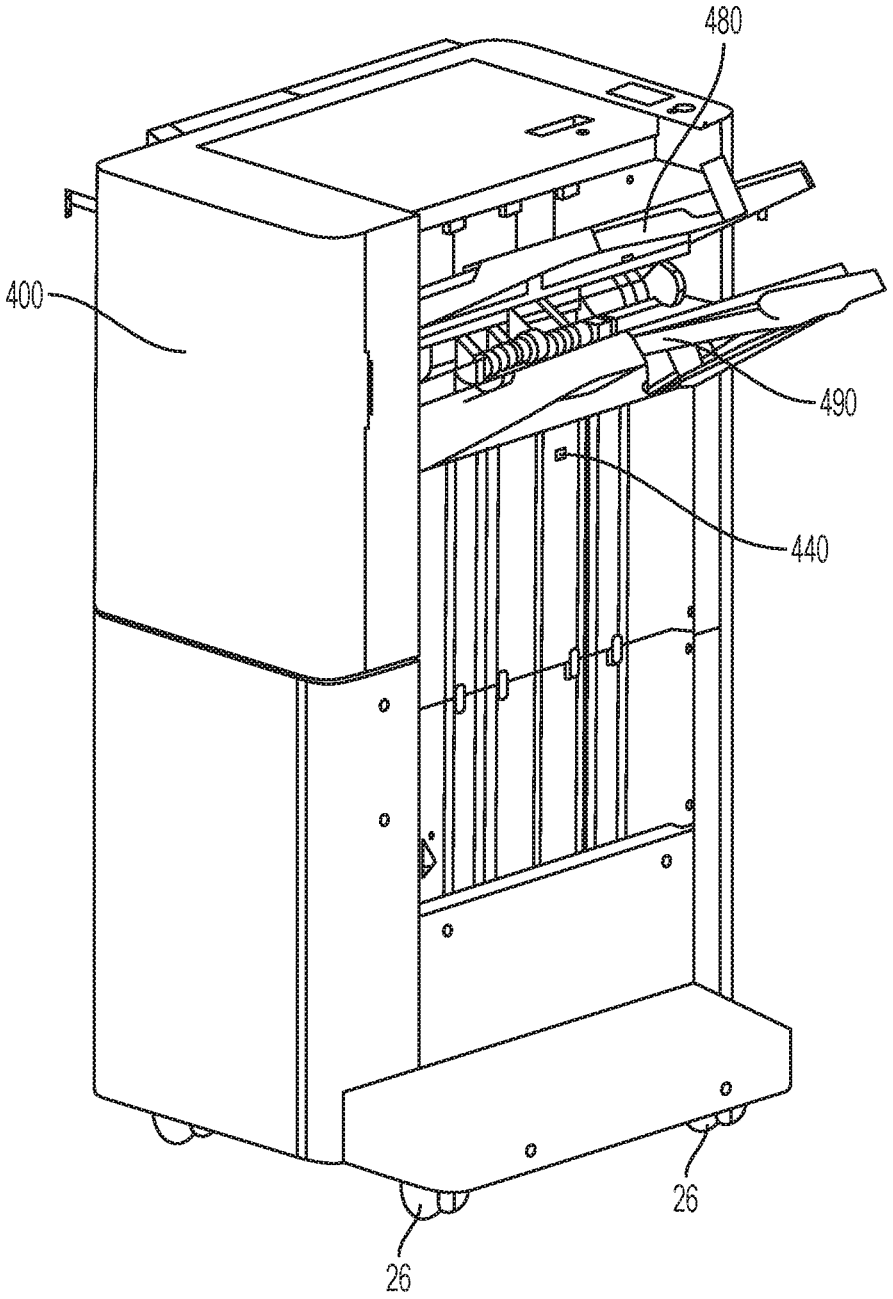
FIG. 7 is a perspective view of a finisher with a supporting based device and a sensor according to an example

For example, FIG. 7 shows a finisher 400 having a sensor 440 located on the same side as the first output bin 480 and second output bin 490. As an example, when the second output bin 490 is fully elevated, the sensor 440 is located below the second output bin 490. As an example, when the second output bin 490 is moved downward to accommodate more output recording medium, the second output bin 490 will pass by the sensor 440. As an example, at this point the sensor 440 is able to detect the presence of the second output bin 490. As an example, when the second output bin 490 moves further downward that it passes the sensor 440 due to the presence of additional recording medium, the sensor 440 is able to detect the presence of the recording medium in the second output bin 490.

For example, the threshold for the sensor 440 to sense either the second output bin 490 or the recording medium in the second output bin 490 could be 400 pages of recording medium. In this example, if the amount of recording medium in the second output bin 490 is 400 pages or more, the sensor 440 would sense either the second output bin 490 or the recording medium.

The proximity sensor or light sensor can transmit a signal to the controller 410 which includes the height information regarding the stack of media or that the sensor sensed the presence of the second output bin 490 or sensed the presence of recording medium in the second output bin 490. The proximity sensor or light sensor can also transmit a signal to the controller 110 which includes the height information regarding the stack of media that the sensor sensed the presence of the second output bin 490 or sensed the presence of recording medium in the second output bin 490. An amount of recording medium in the second output bin 490 can then be determined by the controller 410 based on the height information received from the proximity sensor or light sensor.

The finisher 400 can determine a height of the stack of media according to other methods. For example, the finisher 400 could determine a height of the stack based on a weight of the stack of media determined using a weight sensor. The sensor 440 can include the weight sensor. The weight sensor can transmit a signal to the controller 410 which indicates the weight of the stack of media. The weight sensor can also transmit a signal to the controller 110 which indicates the weight of the stack of media. However, the total weight of the stack of media may not directly correlate with the height of the stack of recording media as certain media may be heavier than others.

As another example, based on the total weight of the stack of media in the upper output bin 480 or in lower output bin 490, a weight of a single recording medium, and a thickness of the recording medium, the controller 410 or controller 110 can determine a number of sheets in the stack and thereafter determine a height of the stack of media. For example, the weight of the single recording medium and the thickness of the recording medium can be determined based on the job information received from the printer 100 or by reference to information stored in the machine readable storage 420. For example, if the total weight sensed by the weight sensor is 250 grams, and the controller 410 receives job information from the printer 100 indicating each recording medium has a thickness of 0.05 mm and a weight of 5 grams, the controller 410 can calculate that 50 sheets are in the upper output bin 480 or in lower output bin 490 and have a stack height of 2.5 mm.

As an example, when the controller 410 determines the sensor 440 sensed the presence of either the second output bin 490 or sensed the presence of recording medium on the second output bin 490, the controller determines the amount of recording medium on the second output bin is greater than a threshold. If the controller 410 determines the amount of recording medium in the second output bin 490 is greater than a threshold, the controller instructs the control panel 130 to display a warning to remove recording medium from the second output bin 490 to help prevent too heavy a load being present in the second output bin 490 when the finisher 400 is to be moved.

As another example, when the controller 410 determines the height of the sheets, the controller 410 then determines if the determined height is greater than a threshold value. If the controller 410 determines the height is greater than a threshold, the controller instructs the control panel 130 to display a warning to remove recording medium from the second output bin 490.

As another example, when the controller 410 determines the weight of the sheets, the controller 410 then determines if the determined weight is greater than a threshold value. If the controller 410 determines the weight is great than a threshold, the controller instructs the control panel 130 to display a warning to remove recording medium from the second output bin 490.

As an example, when the controller 110 determines the sensor 440 sensed the presence of either the second output bin 490 or sensed the presence of recording medium on the second output bin 490, the controller determines the amount of recording medium on the second output bin is greater than a threshold. If the controller 110 determines the amount of recording medium in the second output bin 490 is greater than a threshold, the controller instructs the control panel 130 to display a warning to remove recording medium from the second output bin 490.

In another example, when the controller 110 determines the height of the sheets, the controller 110 then determines if the determined height is greater than a threshold value. If the controller 110 determines the height is greater than a threshold, the controller instructs the control panel 130 to display a warning to remove recording medium from the second output bin 490.

As another example, when the controller 110 determines the weight of the sheets, the controller 110 then determines if the determined weight is greater than a threshold value. If the controller 110 determines the weight is great than a threshold, the controller instructs the control panel 130 to display a warning to remove recording medium from the second output bin 490.

Executable instructions to perform processes or operations in accordance with the above-described examples may be recorded in a machine readable storage. A controller may execute the executable instructions to perform the processes or operations. Examples of instructions include both machine code, such as that produced by a compiler, and files containing higher level code that may be executed by the controller using an interpreter. The instructions may be executed by a processor or a plurality of processors included in the controller. The machine readable storage may be distributed among computer systems connected through a network and computer-readable codes or instructions may be stored and executed in a decentralized manner.

The foregoing examples are merely examples and are not to be construed as limiting the disclosure. The disclosure can be readily applied to other types of apparatuses. Also, the description of the examples of the disclosure is intended to be illustrative, and not to limit the scope of the claims.

What is claimed is:

1. A base device to support a finisher comprising:

a base pan including a section being in a form of a protrusion which protrudes outward from a first side of the base pan;

a first plurality of casters coupled to the base pan to contact a surface while the base pan is level with respect to the surface, each of the first plurality of casters being beside a respective separate corner of the base pan and at least two of the first plurality of casters being beside the protrusion as the section of the base pan;

a second plurality of casters coupled to the protrusion as the section of the base pan, to be positioned above the surface while the base pan is level with respect to the surface and to contact the surface while the base pan is inclined to a first degree of tilt with respect to the surface, each of the second plurality of casters having a diameter smaller than a diameter of each of the first plurality of casters; and a recess, between at least two of the second plurality of casters, to receive a tip foot, the tip foot arranged to:

contact the surface while the base pan is inclined to a second degree of tilt with respect to the surface, the second degree of tilt being different than the first degree of tilt; and be positioned above the surface while the base pan is, with respect to the surface, level or inclined below the second degree of tilt.

2. The base device of claim 1, wherein the recess is coupled to a bottom-side of the base pan.

3. The base device of claim 1, wherein a number of the first plurality of casters is four.

4. The base device of claim 1, wherein a number of the second plurality of casters is two.

5. The base device of claim 1, wherein the first side of the base pan is located below a side of the finisher that receives media output from a printer.

6. The base device of claim 5, wherein a second side of the base pan is located below a side of the finisher that outputs media to a first output bin and a second output bin.

7. The base device of claim 1, wherein the first plurality of casters are adjustable and the second plurality of casters are non-adjustable.

8. The base device of claim 1, wherein the first degree of tilt is a first threshold amount of inclination of the base pan and is based on the diameter of the second plurality of casters.

9. The base device of claim 1, wherein the tip foot:

is removeable from the recess of the base pan; and includes a first end arranged to be inserted into the recess and a second end arranged to extend outward from a perimeter of the base pan.

10. The base device of claim 9, wherein the second degree of tilt is a second threshold of inclination of the base pan and is based on the distance the tip foot is above the surface and the distance the second end of the tip foot extends outward from the perimeter of the base pan.

11. A finisher comprising:

a body;

an input section, on a first side of the body, to receive recording medium from an image forming apparatus;

a finishing section to perform a finishing operation on the received recording medium;

an output section, on a second side of the body and opposite the first side, to output the finished recording medium to an output bin;

a first plurality of casters coupled to a bottom of the body to contact a surface while the bottom of the body is level with respect to the surface, each of the first plurality of casters being beside a respective separate corner of the bottom of the body and at least two of the first plurality of casters being beside an extending section of the bottom of the body being in a form of a protrusion which protrudes outward from the first side of the body;

a second plurality of casters coupled to the protrusion being the extending section of the bottom of the body, to be positioned above the surface while the bottom of the body is level with respect to the surface and to contact the surface while the bottom of the body is inclined to a first degree of tilt with respect to the surface, each of the second plurality of casters having a diameter smaller than a diameter of each of the first plurality of casters; and a recess, between at least two of the second plurality of casters, to receive a tip foot, the tip foot arranged to:

contact the surface while the base pan is inclined to a second degree of tilt with respect to the surface, the second degree of tilt being different than the first degree of tilt; and be positioned above the surface while the base pan is, with respect to the surface, level or inclined below the second degree of tilt.

12. The finisher of claim 11, wherein the finisher further includes a sensor to sense a presence of an output bin or finished recoding medium in the output bin.

13. The finisher of claim 12, wherein the finisher further includes a controller, wherein when the sensor senses the output bin or the finished recording medium in the output bin, the controller determines the amount of finished recoding medium in the output bin is above a threshold.

14. The finisher of claim 13, wherein when an amount of the finished recording medium in the output bin is above the threshold, the controller instructs a control panel to display an image to remove at least some of the finished recording medium from the output bin.

15. The finisher of claim 12, wherein the sensor is on the second side of the body.

16. The finisher of claim 11, wherein the recess is coupled to the bottom of the body.

17. The finisher of claim 11, wherein the first plurality of casters are adjustable and the second plurality of casters are non-adjustable.

18. The finisher of claim 11, wherein a number of the second plurality of casters is two.

* * * * *